US009287630B2

(12) United States Patent
Choudhury et al.

(10) Patent No.: US 9,287,630 B2
(45) Date of Patent: Mar. 15, 2016

(54) DUAL-BAND FOLDED META-INSPIRED ANTENNA WITH USER EQUIPMENT EMBEDDED WIDEBAND CHARACTERISTICS

(71) Applicant: Intel Corporation, Santa Clara, CA (US)

(72) Inventors: Debabani Choudhury, Thousand Oaks, CA (US); Ana Yepes, Hillsboro, OR (US); Vinay Gowda, Folsom, CA (US)

(73) Assignee: Intel Corporation, Santa Clara, CA (US)

( * ) Notice: Subject to any disclaimer, the term of this patent is extended or adjusted under 35 U.S.C. 154(b) by 474 days.

(21) Appl. No.: 13/692,186

(22) Filed: Dec. 3, 2012

(65) Prior Publication Data

US 2014/0152518 A1 Jun. 5, 2014

(51) Int. Cl.

| | |
|---|---|
| ***H01Q 15/02*** | (2006.01) |
| ***H01Q 13/10*** | (2006.01) |
| ***H01Q 1/24*** | (2006.01) |
| ***H01Q 9/40*** | (2006.01) |
| ***H01Q 9/42*** | (2006.01) |
| ***H01Q 5/321*** | (2015.01) |
| ***H01Q 5/357*** | (2015.01) |

(52) U.S. Cl.

CPC ..... *H01Q 13/106* (2013.01); *H01Q 1/243* (2013.01); *H01Q 5/321* (2015.01); *H01Q 5/357* (2015.01); *H01Q 9/40* (2013.01); *H01Q 9/42* (2013.01)

(58) Field of Classification Search

USPC ..... 343/700 MS, 702, 729, 753

See application file for complete search history.

(56) References Cited

U.S. PATENT DOCUMENTS 6,014,113 A * 1/2000 Orchard ..... H01Q 1/40 343/702
6,133,880 A * 10/2000 Grangeat ..... H01P 5/08 343/700 MS
6,346,914 B1 * 2/2002 Annamaa ..... H01Q 1/243 343/700 MS (Continued)

FOREIGN PATENT DOCUMENTS

WO 2010007647 * 6/2010
WO WO-2010070647 A1 6/2010

OTHER PUBLICATIONS

"International Application Serial No. PCT/US2013/044080, International Search Report mailed Aug. 26, 2013", 3 pgs, 2013.

(Continued)

*Primary Examiner* — Hoang V Nguyen
*Assistant Examiner* — Hai Tran
(74) *Attorney, Agent, or Firm* — Schwegman Lundberg & Woessner, P.A.

(57) ABSTRACT

Embodiments of a folded meta-inspired antenna for dual-band operation and user equipment for dual-band operation in a wireless network are generally described herein. In some embodiments, the folded meta-inspired antenna may include first and second conductive layers disposed on opposite sides of a substrate to provide a wideband distributed structure comprising a plurality of high-Q resonances resulting from, at least in part, metamaterial-based loading. Conductive material on the first side of the substrate is arranged around a central longitudinal slot coupled with a plurality of perpendicular slots. For dual-band operation, the folded meta-inspired antenna may operate as a folded monopole at a higher frequency band and operate as a slot-type radiator at a lower frequency band. The plurality of resonances may cause the folded meta-inspired antenna to achieve broader bandwidth at both lower and higher frequency bands.

18 Claims, 3 Drawing Sheets

(56) References Cited

U.S. PATENT DOCUMENTS

| | | | | |
|---|---|---|---|---|
| 7,227,506 | B1 | 6/2007 | Lewis, Jr. | |
| 2006/0125703 | A1 * | 6/2006 | Ma | H01Q 13/103 343/767 |
| 2010/0149048 | A1 | 6/2010 | Lin | |
| 2011/0254749 | A1 | 10/2011 | Amari et al. | |

OTHER PUBLICATIONS

"International Application Serial No. PCT/US2013/044080, Written Opinion mailed Aug. 26, 2013", 8 pgs, 2013.

Antoniades, Marco A, et al., "A Broadband Dual-Mode Monopole Antenna Using NRI-TL Metamaterial Loading", IEEE Antennas and Wireless Propagation Letters, 3, (2009), 258-261, 2009.

Kuo, Yen-Lang, "Printed double-T monopole antenna for 2.4/5.2 GHz dual-band WLAN operations", IEEE Transactions on Antennas and Propagation, 51(9), (Sep. 2003), 2187-2192, 2003.

Zhu, J., et al., "Dual-band metamaterial-inspired small monopole antenna for WiFi applications", Electronics Letters, 45(22), (2009), 1104-1106, 2009.

"International Application Serial No. PCT/US2013/044080, International Preliminary Report on Patentability mailed Jun. 18, 2015", 10 pgs, 2015.

* cited by examiner

DUAL-BAND FOLDED META-INSPIRED ANTENNA WITH USER EQUIPMENT EMBEDDED WIDEBAND CHARACTERISTICS

TECHNICAL FIELD

Embodiments pertain to wireless communications. Some embodiments relate to mobile wireless platforms. Some embodiments relate to antennas. Some embodiments relate to antennas with wide frequency band characteristics at long wavelengths within small antenna volumes. Some embodiments relate to antennas suitable for integration within smartphones and other types of wireless platforms. Some embodiments relate to wireless communication devices including user equipment (UE).

BACKGROUND

As the form-factor of mobile wireless platforms is showing a decreasing trend, more and more radio frequency bands are being added, increasing antenna functionalities to be integrated within smaller devices, such as smartphones. Commercially available smartphone antennas currently do not provide the needed broad bandwidth and coverage for multi-band applications such as LTE and 4G. As smartphones are becoming thinner and the display is getting larger, the space available for antenna elements is becoming increasingly smaller. This makes it increasingly difficult for a single antenna to cover bandwidths at both the lower frequency bands (e.g., MHz) as well as the higher frequency bands (e.g., GHz). Furthermore, antenna performance becomes compromised due to the close proximity of platform structures that impact antenna characteristics.

Conventionally, antenna switching and tuning techniques have been utilized to cover different frequency bands; however, these techniques introduce loss and latency and may result in nonlinearity and noise under certain operating conditions, making these techniques unsuitable for the high-demands of many smartphone applications. Further, simultaneous multi-band operation is difficult with these conventional switching and tuning techniques. Simultaneous operation also becomes challenging with tunable antenna architectures.

Another issue with many conventional antennas in smaller-form-factor platforms is the ground plane. Conventionally, smaller antennas may need to utilize a larger ground plane, such as the platform chassis, that operates as part of the radiator to achieve acceptable performance. This results in a number of performance issues, including isolation and mutual coupling.

Thus there are general needs for antennas suitable for use in mobile wireless platforms that can support multi-band operation and with a small form factor. There are also general needs for broadband and highly-efficient antennas suitable for use in wireless platforms. There are also general needs for wireless platforms configured for multi-band operation.

BRIEF DESCRIPTION OF THE DRAWINGS

FIGS. 3A, 3B and 3C illustrate user equipment (UE) in accordance with some embodiments.

DETAILED DESCRIPTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Figure 1:
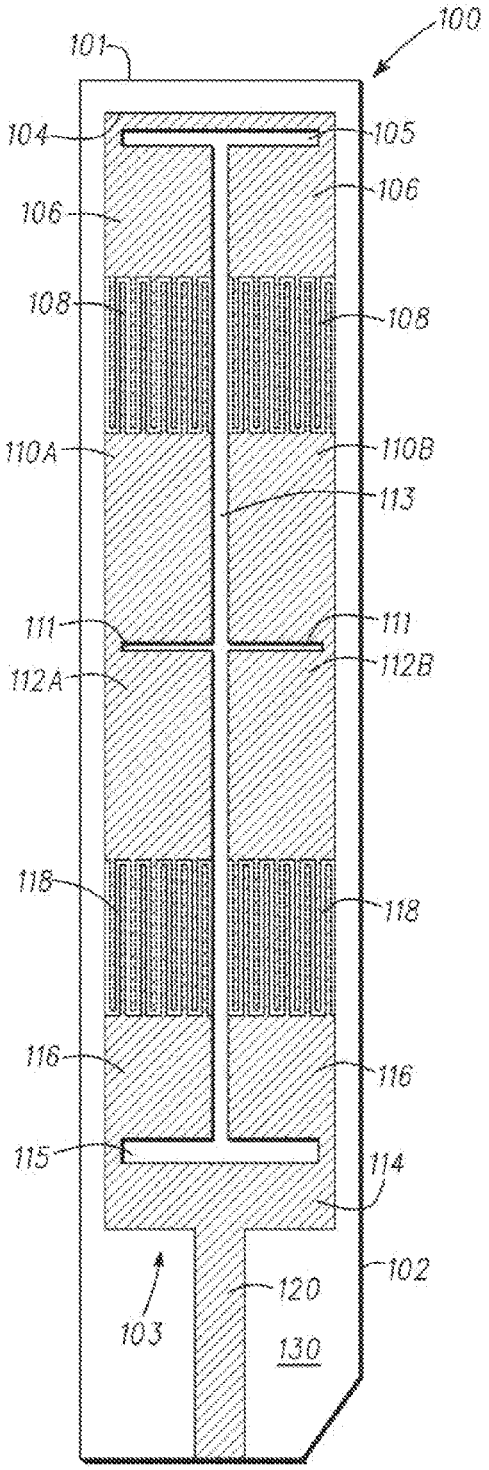
FIG. 1 illustrates a first side of a folded meta-inspired antenna in accordance with some embodiments.
Figure 2:
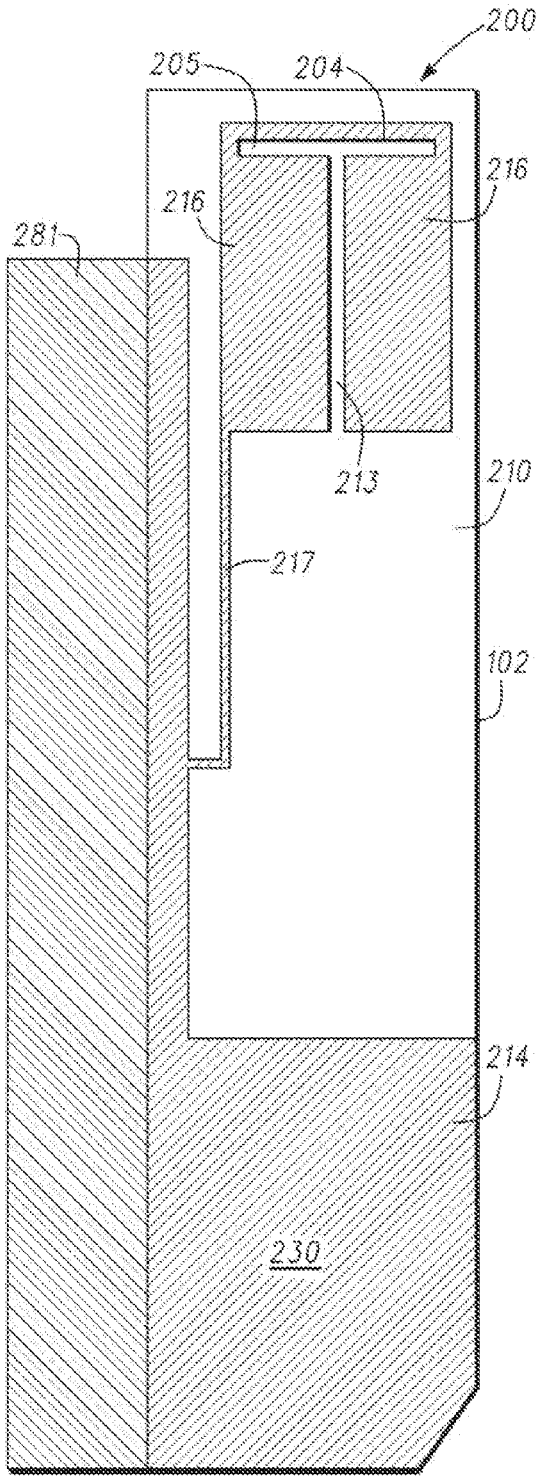
FIG. 2 illustrates a second side of a folded meta-inspired antenna in accordance with some embodiments.

FIG. 1 illustrates a first side of a folded meta-inspired antenna in accordance with some embodiments. FIG. 2 illustrates a second side of a folded meta-inspired antenna in accordance with some embodiments. The folded meta-inspired antenna of FIGS. 1 and 2 is an example of a folded antenna loaded with meta-inspired concepts. In accordance with embodiments, the folded meta-inspired antenna illustrated in FIGS. 1 and 2 is configured for multi-band operation. The folded meta-inspired antenna comprises first and second conductive layers 100, 200 disposed on first and second opposite sides 130, 230 of a substrate 102 to provide a wideband distributed structure comprising a plurality of high-Q resonances. The high-Q resonances comprise a plurality of L-C resonances resulting from at least in part metamaterial concept-based loading. In accordance with embodiments, the high-Q resonances in proximity may provide a broader bandwidth, particularly at a lower band.

In some embodiments, the folded two layer structure results in a monopole that can achieve wideband performance at the lower frequency band. The multiple slots and capacitance combinations help provide this wideband performance with high-efficiency, which has been conventionally difficult to achieve in particular at the lower frequency band.

In accordance with some embodiments, the conductive material on the first side 130 of the substrate 102 is arranged around a central longitudinal slot 113 coupled with a plurality of perpendicular slots. For dual-band operation, the plurality of resonances causes the folded meta-inspired antenna to operate as a folded monopole at a higher frequency band and to operate as a slot-type radiator at a lower frequency band. These embodiments are described in more detail below. In some embodiments, when operating as a folded monopole, current flows in a same direction along the central longitudinal slot 113 on both sides of the substrate 102. When operating as a slot-type radiator, current flows around a perimeter of the central longitudinal slot 113 and the plurality of perpendicular slots.

The perpendicular slots include an upper slot 105, a middle slot 111, and a lower slot 115. The upper slot 105, the middle slot 111 and the lower slot 115 are perpendicular to the central longitudinal slot 113. The conductive material on the first side 130 includes a thin inductive strip 104 at a first end 101 forming a shunt inductance, a transmission line region 114 at an opposite end 103 and a plurality of interdigital capacitors 108, 118 arranged to provide the distributed high-Q structures. In these embodiments, the upper slot 105 is provided at the first end 101 of the folded meta-inspired antenna and is connected to the central longitudinal slot 113 at the first end 101. The lower slot 115 may be provided at the opposite end 103 of the folded meta-inspired antenna and may be connected to the central longitudinal slot 113 at the opposite end 103. As illustrated in FIG. 1 the lower slot 115, the upper slot 105 and the central longitudinal slot 113 may form a dumbbell or double-ended 'T' shape with a slot (e.g., middle slot 111) in the middle.

In some of these embodiments, the folded meta-inspired antenna employs meta-material based concepts on low-cost plastic substrates including Ajinomoto Build-up Film (ABF) type materials and printed circuit board (PCB) materials, which may be suitable for use as substrate 102. In these embodiments, meta-inspired loading is employed in a planar antenna structure that is configured for at dual-band operation. The first side 130 may be considered the top side and the opposite side 230 (FIG. 2) may be considered the bottom side, although the scope of the embodiments is not limited in this respect. In these embodiments, the opposite end 103 may be opposite the first end 101 as illustrated in FIG. 1

Figure 3A:
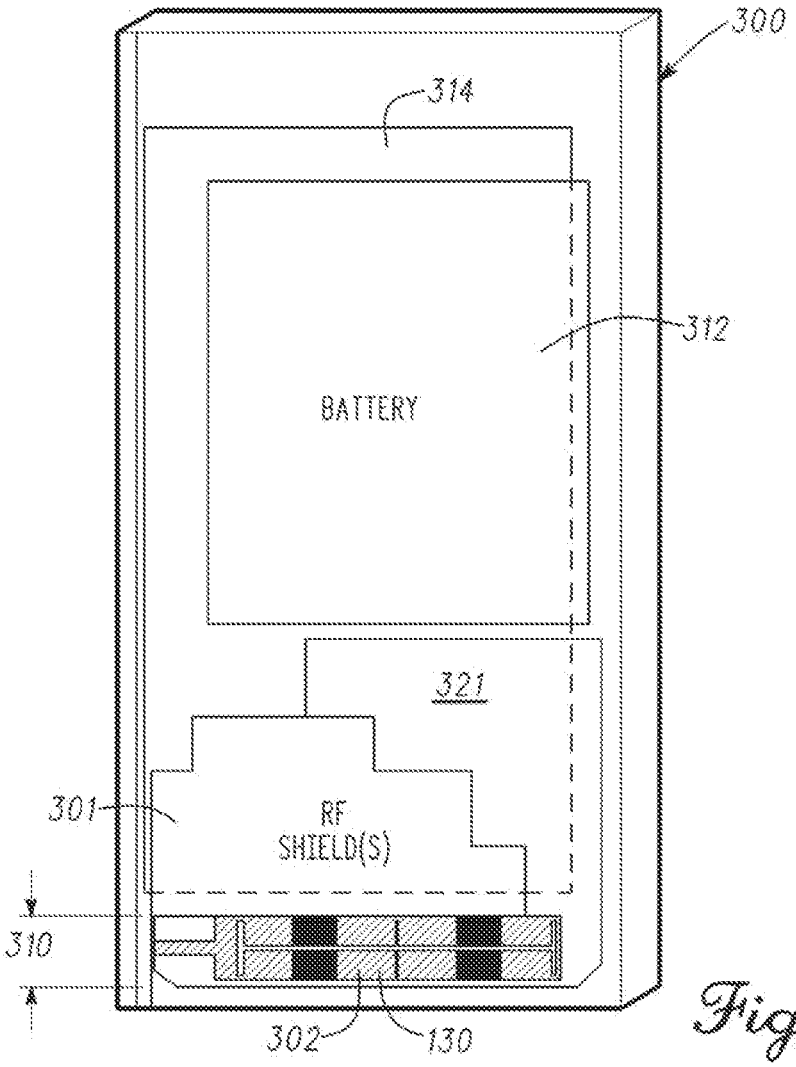
Figure 3B:
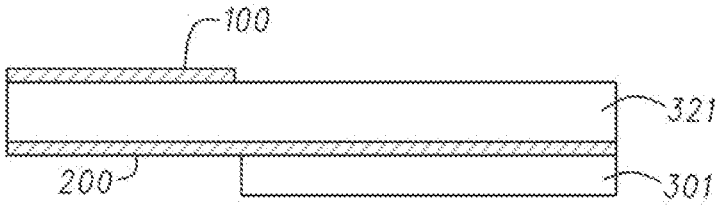

FIGS. 3A, 3B and 3C illustrate user equipment (UE) in accordance with some embodiments. UE 300 may include, among other things, a folded meta-inspired antenna 302. The folded meta-inspired antenna illustrated in FIGS. 1 and 2 may be suitable for use as the folded meta-inspired antenna 302 of UE 300. As illustrated in FIG. 3A, RF shields 301 may be provided on top of the radio modules of UE 300 and may be provided in close proximity to ground plane region 214 (FIG. 2) of the second conductive layer 200 (FIG. 2) to extend the antenna ground area. These embodiments are described in more detail below.

In these example embodiments, an antenna holder 321 may be used to hold the folded meta-inspired antenna 302 within the structure of UE 300 and may be used to define the folded meta-inspired antenna structure. In these embodiments, antenna holder 321 may serve as substrate 102 (FIGS. 1 and 2) and may be part of the mechanical design of the UE 300. In these example embodiments, the antenna holder 321 may comprise a plastic material, such as ABF type material, although this is not a requirement as other substrate materials may be used.

FIG. 3B is a cross-sectional view showing the locations of RF shields 301, antenna holder 321 as well as first conductive layer 100 and second conductive layer 200 of the folded meta-inspired antenna 302 in accordance with some example embodiments. FIG. 3C is a view showing the antenna holder 321 in accordance with some example embodiments.

In accordance with embodiments, the UE 300 may include physical-layer circuitry coupled to the folded meta-inspired antenna 302 which may be configured for communicating with an enhanced node B (eNB) of an LTE network using at least one of a higher and a lower frequency band. The physical layer circuitry may transmit and receive OFDMA signals in accordance with one of the 3GPP LTE standards using the folded meta-inspired antenna 302. The physical layer circuitry may include one or more radio modules including baseband processing circuitry which may be shielded by RF shields 301. UE 300 may be almost any wireless platform. In accordance with embodiments, the folded meta-inspired antenna 302 may need only a small ground plane and therefore can easily be embedded in any wireless device including wireless devices with a form-factor much smaller than that of a smartphone.

The embodiments of UE 300 illustrated in FIG. 3A are a back view in which the first side 130 and first conductive layer 100 of the folded meta-inspired antenna 302 are shown as being embedded toward the back side. UE 300 may also include battery 312, circuit board 314 (which may be a printed circuit board), a frame and a display assembly.

In the example illustrated in FIG. 3A, the folded meta-inspired antenna 302 may have a width dimension 310 not exceeding a predefined space for antenna element definition. In some embodiments, the width dimension 310 may be approximately 8.0 mm, although the scope of the embodiments is not limited in this respect. Details of other UE 300 features, such as speakerphone, USB, microphone and other metal-based components underneath and around the folded meta-inspired antenna 302 and within the space, are not shown in FIG. 3A.

Figure 4:
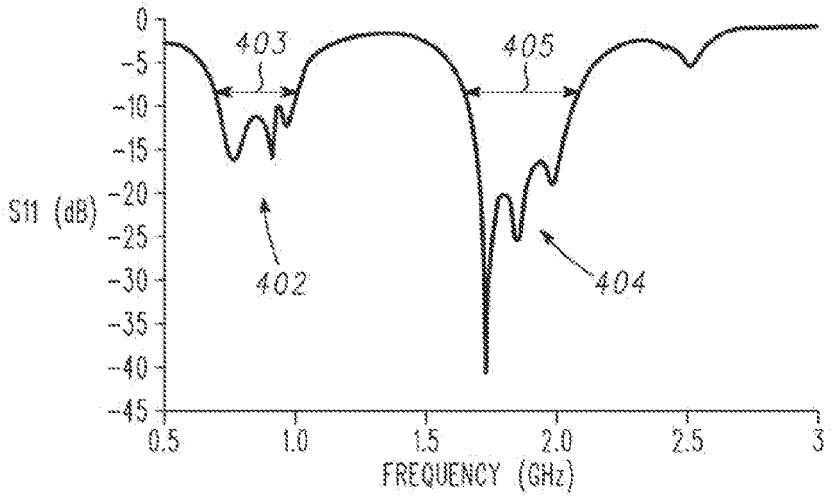
FIG. 4 illustrates return-loss of an example embodiment showing a wide bandwidth within first and second frequency bands.

FIG. 4 illustrates return-loss of an example embodiment showing a wide bandwidth within first and second frequency bands. The wide bandwidth within the first and second frequency bands may result from a plurality of high-Q resonances adjacent to one another. In some embodiments, the plurality of resonances of distributed high-Q structures within the folded meta-inspired antenna of FIGS. 1 and 2 may be selected to provide a first wide bandwidth within a lower frequency band and a second wide bandwidth within a higher frequency band. As illustrated in FIG. 4, the first frequency band 402 may be the lower frequency band and the second frequency band 404 may be the higher frequency band. In some embodiments, multiple high-Q resonances may be placed close or adjacent to each other within the structure of the folded meta-inspired antenna to achieve wider bandwidths in each frequency band.

In some embodiments, the first and second frequency bands 402, 404 may be non-overlapping frequency bands. In some LTE embodiments, the first and second frequency bands 402, 404 may be the low and high LTE frequency bands. In some example embodiments, the first frequency band 402 may be around a center frequency of approximately 0.8 GHz and the second frequency band 404 may be around a center frequency of approximately 1.83 GHz. FIG. 4 illustrates the return-loss of an example embodiment showing wide bandwidth resulting from multiple resonances within the first and second frequency bands 402, 404. In some embodiments, the first frequency band 402 may have a bandwidth 403 of at least 260 MHz and the second frequency band may have a bandwidth 405 of at least 400 MHz (e.g., where the return loss exceeds −10 dB), although the scope of the embodiments is not limited in this respect.

In accordance with embodiments, the folded meta-inspired antenna may achieve increased wider bandwidths for both the first frequency band 402 and the second frequency band 404 by merging multiple resonances, which are implemented with printed meta-inspired resonant structures within a folded monopole structure on the substrate 102. As explained in more detail below, multiple combinations of capacitances and inductances introduce multiple resonances combined together to create a broad-bandwidth. This is unlike some conventional transmission-line based meta-inspired structure loaded planar antennas which implement high-Q resonant radiators with small size but suffer from narrow bandwidth.

Referring back to FIG. 1, in some embodiments the conductive material on the first side 130 may further include first and second upper transmission line sections 106 provided between the upper slot 105 and first and second of the interdigital capacitors 108, first and second central transmission line sections 110A, 110B, and third and fourth central transmission line sections 112A, 112B. The upper slot 105 separates the inductive strip 104 from the first and second upper transmission line sections 106, the first and second upper transmission line sections 106 are separated by the central longitudinal slot 113, and the first and second of the interdigital capacitors 108 are separated by the central longitudinal slot 113. In these embodiments, the first and second central transmission line sections 110A, 110B are separated by the central longitudinal slot 113, the third and fourth central transmission line sections 112A, 112B are separated by the central longitudinal slot 113, the first and third central transmission line sections 110A, 112A are separated by the middle slot 111, and the second and fourth central transmission line sections 110B, 112B are separated by the middle slot 111. In these embodiments, the first and second upper transmission line sections 106, and the conductive material in-between, form capacitance with conductive material of transmission line sections 216 (FIG. 2) on the opposite side 230 of the substrate 102, described in more detail below.

In these embodiments, open region 210 (FIG. 2) on the opposite side 230 of the substrate 102 may be opposite these central transmission sections (i.e., the first and second central transmission line sections 110A, 110B and the third and fourth central transmission line sections 112A, 112B). The open region 210 may be devoid of conductive material and therefore little or no capacitance may be formed by the first, second, third and fourth central transmission line sections 110A, 110B, 112A, 112B with conductive material on the opposite side 230 of the substrate 102.

In some embodiments, the conductive material on the first side 130 may also include first and second lower transmission line sections 116 provided between the lower slot 115 and third and fourth of the interdigital capacitors 118. The lower slot 115 may separate the transmission line region 114 from the first and second lower transmission line sections 116, the first and second lower transmission line sections 116 may be separated by the central longitudinal slot 113, and the third and fourth of the interdigital capacitors 118 may be separated by the central longitudinal slot 113. In these embodiments, the first and second lower transmission line sections 116 form capacitance with the conductive material on the opposite side 230 of the substrate 102.

In some embodiments, the conductive material on the first side 130 may also include a transmission line section 120 coupling the transmission line region 114 to a feed. In some embodiments, the feed may be a coaxial feed, although this is not a requirement. The transmission line section 120 may be any type of RF transmission line. In some embodiments, the transmission line section 120 may be a 50 ohm microstrip feed transmission line section or a coplanar waveguide 50 ohm transmission line section, although this is not a requirement. In some embodiments, the use of coplanar metal feed structures for exciting the antenna may eliminate the need for any thru-vias through the antenna structure.

In some embodiments, the conductive material on the first side 130 may also include conductive material disposed at opposite ends of the middle slot 111 near the edge of the substrate 102 to couple the first and third central transmission line sections 110A, 112A and to couple the second and fourth central transmission line sections 110B, 112B to allow surface current to flow around the middle slot 111. In some embodiments, the conductive material on the first side 130 may also include conductive material at opposite ends of the upper slot 105 near the edge of the substrate 102 to couple the first and second upper transmission line sections 106 with the inductive strip 104 to allow surface current to flow around the upper slot 105. The conductive material on the first side 130 may also include conductive material at opposite ends of the lower slot 115 near the edge of the substrate 102 to couple the first and second lower transmission line sections 116 with the transmission line region 114 to allow surface current to flow around the lower slot 115.

Figure 3B:
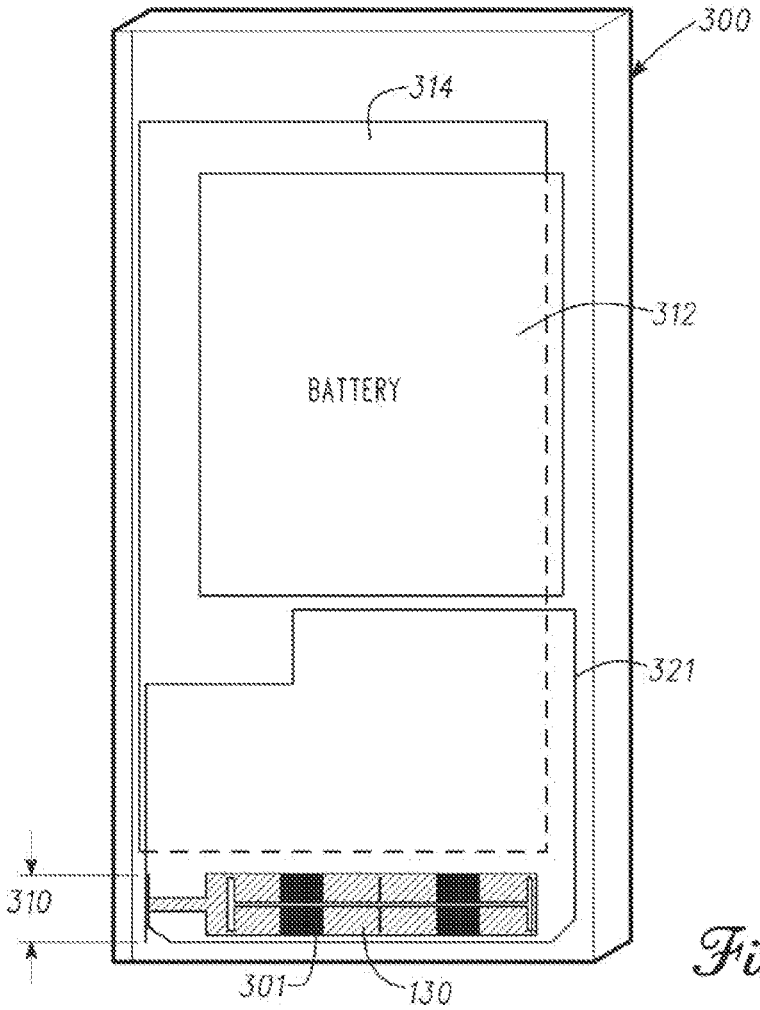

Referring back to FIG. 2, in some embodiments, the second side 230 may be considered a ground plane side comprising conductive material. In these embodiments, the conductive material of the second side 230 may include an inductive strip 204, first and second upper transmission line sections 216, and a ground plane region 214 coupled to one of the first and second upper transmission line sections 216. An upper slot 205 separates the inductive strip 204 from the first and second upper transmission line sections 216, and the first and second upper transmission line sections 216 are separated by the central longitudinal slot 213. A thin strip inductor 217 may connect the transmission line sections 216 to the ground plane region 214. In accordance with some embodiments, the ground plane region 214 on the bottom of the substrate 102 may be connected to a ground plane 281 of a wireless platform, such as UE 300 (FIG. 3).

In some embodiments, the folded meta-inspired antenna 302 may be contained within a volume of no greater than 42×8.0×1.0 cu-mm for operating simultaneously in both the lower and higher LTE bands. In these embodiments, the ground plane 281 (FIG. 2) or the RF shields 301 (FIG. 3) may be combined with ground plane region 214 of the second conductive layer 200 to achieve dual-band performance with a broad bandwidth. In some embodiments, an RF shield area or ground plane region area of approximately 46 mm×25 mm may be used to achieve dual-band performance with a broad bandwidth, although the scope of the embodiments is not limited in this respect.

In accordance with some embodiments, at the higher frequency band (i.e., second frequency band 404), the folded meta-inspired antenna operates as a folded monopole supporting even-mode current (i.e., the current flows in the same direction). During folded monopole operation, the interdigital capacitors 108, 118 operate as shorts, and the thin inductive strips 104, 204 operate as open circuits. During folded monopole operation, the current may flow in the same direction on both sides of the central longitudinal slot 113. Zero (or almost zero) phase difference may exist between the current on the first conductive layer 100 through the microstrip feed (i.e., transmission line section 120) and the current on the second conductive layer 200 through transmission line sections 216 as well as the thin strip inductor 217 connecting transmission line sections 216 with ground plane region 214. In these embodiments, an electric field polarization may be created with a direction in-line with the length of this monopole-type structure with currents flowing in the same direction in both sides of the central longitudinal slot 113. Inductances may be formed by the various transmission line sections (e.g., transmission line sections 120, 114, 116, 112, 110, 106, and 216) and the thin strip inductor 217. Capacitance may be formed by the parallel plate capacitance between the conductive material of the first side 130 and the conductive material of the second side 230. In some embodiments, capacitances may also be formed with interdigital fingers between different transmission line metal parts on the first conductive layer 100.

In accordance with some embodiments, at the lower frequency band (i.e., the first frequency band 402), current may flow around the perimeter of slots 105, 111, 115 and 113 inducing an electric field around the slot areas in the direction orthogonal to the current direction, providing a slot-type radiation at the lower frequency band. Multiple slots (i.e., slots 105, 111, 115) perpendicular to the main slot (i.e., central longitudinal slot 113) in the first conductive layer 100 as well as an upper slot 205 perpendicular to central longitudinal slot 213 in the second conductive layer 200 alter the current distribution path on the monopole-type structure. The interdigital capacitors 108 and 118 may further alters the current distribution on the planar antenna surface. Loading of the antenna with slots 105, 111, 115 and interdigital capacitors

108, 118 may create multiple resonances and provide broader bandwidth with comparably higher-efficiency values in the lower frequency band.

In accordance with embodiments, small antennas loaded with low-cost, material-based, meta-inspired structures may be able to achieve broader-bandwidth while retaining high-efficiency. Some embodiments of the folded meta-inspired antenna implement a creative combination of different inductive and capacitive elements using a low-cost, two metal-layer on-plastic substrate approach without vias within the antenna structure. Some embodiments of the folded meta-inspired antenna are loaded with inductive and capacitive elements to form a meta-inspired loaded structure that provides a highly efficient, dual band and broad-bandwidth antenna with a much smaller form factor than could be achieved with conventional methods at certain frequencies of interest (e.g., LTE bands). Some embodiments of the folded meta-inspired antenna use multiple slots and multiple interdigital capacitors to form meta-inspired structures to provide ultra-broad bandwidth at lower LTE frequency band. In some of these embodiments, the broad bandwidth may cover the entire lower LTE frequency band. In some of these embodiments, the broad bandwidth may be achieved within a small form factor and without using any active or tuning device. Conventionally, tunable devices are used to cover wide bandwidths, but tend to increase loss, reduce the efficiency of antennas and increase the potential for noise generation. The folded meta-inspired antenna of some embodiments cover a desired bandwidth with only linear transmission line based meta-inspired structures.

Referring back to FIG. 3, in some embodiments, the UE 300 may be a portable wireless communication device, such as a personal digital assistant (PDA), a laptop or portable computer with wireless communication capability, a web tablet, a wireless telephone, a smartphone, a wireless headset, a pager, an instant messaging device, a digital camera, an access point, a television, a medical device (e.g., a heart rate monitor, a blood pressure monitor, etc.), or other device that may receive and/or transmit information wirelessly. In some embodiments, the UE 300 may include one or more of a keyboard, a display, a non-volatile memory port, multiple antennas, a graphics processor, an application processor, speakers, and other mobile device elements. The display may be an LCD screen including a touch screen. In some embodiments, the UE 300 may be a wearable computing device having an ultra-small form factor.

Although UE 300 is illustrated as having several separate functional elements, one or more of the functional elements may be combined and may be implemented by combinations of software-configured elements, such as processing elements including digital signal processors (DSPs), and/or other hardware elements. For example, some elements may comprise one or more microprocessors. DSPs, field-programmable gate arrays (FPGAs), application specific integrated circuits (ASICs), radio-frequency integrated circuits (RFICs) and combinations of various hardware and logic circuitry for performing at least the functions described herein. In some embodiments, the functional elements of UE 300 may refer to one or more processes operating on one or more processing elements.

UE 300 may also include processing circuitry and memory. The processing circuitry may be configured to determine several different feedback values discussed below for transmission to the eNB. The processing circuitry may also include a media access control (MAC) layer. In some embodiments, the UE 300 may be configured to receive OFDM communication signals over a multicarrier communication channel. The OFDM signals may comprise a plurality of orthogonal subcarriers. In some broadband multicarrier embodiments, eNBs may be part of a broadband wireless access (BWA) network communication network, such as a 3rd Generation Partnership Project (3GPP) Universal Terrestrial Radio Access Network (UTRAN) Long-Term-Evolution (LTE) or a Long-Term-Evolution (LTE) communication network, although the scope of the inventive subject matter is not limited in this respect. In these broadband multicarrier embodiments, the UE 300 and the eNBs may be configured to communicate in accordance with an orthogonal frequency division multiple access (OFDMA) technique. The UTRAN LTE standards include the 3rd Generation Partnership Project (3GPP) standards for UTRAN-LTE, release 8, March 2008, and release 10, December 2010, including variations and evolutions thereof.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. An antenna configured for dual-band operation comprising:

first and second conductive layers disposed on opposite sides of a substrate to provide a wideband distributed structure comprising a plurality of high-Q resonances resulting from at least in part metamaterial-based loading, wherein conductive material on a first side of the substrate is arranged around a central longitudinal slot coupled with a plurality of perpendicular slots, and wherein for dual-band operation, the plurality of high-Q resonances cause the antenna to operate as a folded monopole at a higher frequency band to cause current to flow in a same direction along the central longitudinal slot on both sides of e substrate and operate as a slot-type radiator at a lower frequency.

2. The antenna of claim 1 wherein when operating as a folded monopole, current flows in a same direction along the central longitudinal slot on both sides of the substrate, and wherein when operating as a slot-type radiator, current flows around a perimeter of the central longitudinal slot and the plurality of perpendicular slots.

3. The antenna of claim 2 wherein the perpendicular slots include an upper slot, a middle slot, and a lower slot, the upper slot, the middle slot and the lower slot being perpendicular to the central longitudinal slot, and wherein the conductive material on the first side includes an inductive strip at a first end forming a shunt inductance, a transmission line region at a second end, and a plurality of interdigital capacitors, arranged to provide the high-Q resonances in close proximity with one another resulting in wider bandwidth.

4. The antenna of claim 2 wherein the antenna is a folded meta-inspired antenna and is contained within a volume of no greater than 42×8.0×1.0 cu-mm.

5. The antenna of claim 3 wherein the lower slot, the upper slot and the central longitudinal slot form a dumbbell shape.

6. The antenna of claim 5 wherein the plurality of high-Q resonances of the wideband distributed structure are selected to provide a first wide bandwidth resulting from the plurality of resonances within the lower frequency band and a second wide bandwidth resulting from the plurality of resonances within the higher frequency band.

7. The antenna of claim 6 wherein the conductive material on the first side further includes:

first and second upper transmission line sections provided between the upper slot and first and second of the plurality of the interdigital capacitors, first and second central transmission line sections; and third and fourth central transmission line sections, wherein the upper slot separates the inductive strip from the first and second upper transmission line sections, wherein the first and second upper transmission line sections are separated by the central longitudinal slot, wherein the first and second of the interdigital capacitors are separated by the central longitudinal slot, wherein the first and second central transmission line sections are separated by the central longitudinal slot, wherein the third and fourth central transmission line sections are separated by the central longitudinal slot, wherein the first and third central transmission line sections are separated by the middle slot, and wherein the second and fourth central transmission line sections are separated by the middle slot.

8. The antenna of claim 7 wherein the conductive material on the first side further includes:

first and second lower transmission line sections provided between the lower slot and third and fourth of the interdigital capacitors, wherein the lower slot separates the transmission line region from the first and second lower transmission line sections, wherein the first and second lower transmission line sections are separated by the central longitudinal slot, and wherein the third and fourth of the interdigital capacitors are separated by the central longitudinal slot.

9. The antenna of claim 7 wherein a second side of the substrate is a ground plane side comprising conductive material, wherein the conductive material of the second side comprises;

an inductive strip;

first and second upper transmission line sections; and a ground plane region coupled to one of the first and second upper transmission line sections, wherein an upper slot separates the inductive strip from the first and second upper transmission line sections, wherein the first and second upper transmission line sections are separated by the central longitudinal slot, and wherein a thin strip inductor connects the first and second upper transmission line sections to the ground plane region.

10. The antenna of claim 8 wherein the conductive material on the first side further includes:

a transmission line section coupling the transmission line region for antenna excitement.

11. The antenna of claim 8 wherein the conductive material on the first side further includes:

conductive material disposed at opposite ends of the middle slot to couple the first and third central transmission line sections and to couple the second and fourth central transmission line sections to allow surface current to flow around the middle slot;

conductive material at opposite ends of the upper slot to couple the first and second upper transmission line sections with the inductive strip to allow surface current to flow around the upper slot; and conductive material at opposite ends of the lower slot to couple the first and second lower transmission line sections with the transmission line region to allow surface current to flow around the lower slot.

12. User Equipment (UE) configured for dual-band operation comprising:

an antenna; and physical-layer circuitry coupled to the antenna configured for communicating with an enhanced node B (eNB) simultaneously using a higher and a lower frequency band, wherein the antenna comprises first and second conductive layers disposed on opposite sides of a substrate to provide a wideband distributed structure comprising a plurality of high-Q resonances resulting from at least in part metamaterial-based loading, and wherein for dual-band operation, the plurality of resonances cause the antenna to operate as a folded monopole at a higher frequency band to cause current to flow in a same direction along the central longitudinal slot on both sides of the substrate, and operate as a slot-type radiator at a lower frequency band.

13. The UE of claim 12 wherein the antenna comprises:

conductive material on a first side of the substrate arranged around a central longitudinal. slot coupled with a plurality of perpendicular slots, the perpendicular slots including an upper slot, a middle slot, and a lower slot, the upper slot, the middle slot and the lower slot being perpendicular to the central longitudinal slot, wherein the conductive material on the first side including an inductive strip at a first end forms a shunt inductance, a transmission line region at a second end, and a plurality of interdigital capacitors, and wherein the lower slot, the upper slot and the central longitudinal slot form a dumbbell shape.

14. The UE of claim 13 wherein when the antenna operates as a folded monopole, current flows in a same direction along the central longitudinal slot on both sides of the substrate, and wherein when the antenna operates as a slot-type radiator, current flows around a perimeter of the central longitudinal slot and the plurality of perpendicular slots.

15. The LIE of claim 14 wherein the physical-layer circuitry is to transmit and receive orthogonal frequency division multiple access (OFDMA) signals in accordance with one of the 3GPP LTE standards using the antenna.

16. The LIE of claim 14 further comprising one or more RE shields to shield at least some of the physical-layer circuitry, wherein the substrate comprises a plastic material and is part of an antenna holder within. the UE, and wherein the one or more RE shields are coupled to a ground plane region of the antenna.

17. A dual-band antenna comprising:

conductive material on a first side of a substrate arranged around a central longitudinal slot coupled with a plurality of perpendicular slots, the perpendicular slots including an upper slot, a middle slot, and a lower slot, the upper slot, the middle slot and the lower slot being perpendicular to the central longitudinal slot; and the conductive material on the first side including an inductive strip at a first end forming a shunt inductance, a transmission line region at a second end and a plurality of interdigital capacitors, wherein the lower slot, the upper slot and the central longitudinal slot form a dumbbell shape and wherein for dual-band operation, the antenna is to operate as a folded monopole at a higher frequency band in which current is to flow in a same direction along the central longitudinal slot on both sides of the substrate.

18. The antenna of claim 17 wherein a second side of the substrate is a ground. plane side comprising:

an inductive strip;

first and second upper transmission line sections; and a ground plane region coupled to one of the first and second upper transmission line sections, wherein an upper slot separates the inductive strip from the first and second upper transmission line sections, wherein the first and second upper transmission line sections are separated by the central longitudinal slot, and wherein a thin strip inductor connects the first and second upper transmission line sections to the ground plane region.

* * * * *